US009924814B2

(12) United States Patent
Colby

(10) Patent No.: US 9,924,814 B2
(45) Date of Patent: Mar. 27, 2018

(54) CUP SLEEVE

(71) Applicant: Michael K. Colby, Eagle, ID (US)

(72) Inventor: Michael K. Colby, Eagle, ID (US)

( * ) Notice: Subject to any disclaimer, the term of this patent is extended or adjusted under 35 U.S.C. 154(b) by 367 days.

(21) Appl. No.: 14/810,324

(22) Filed: Jul. 27, 2015

(65) Prior Publication Data

US 2015/0327701 A1 Nov. 19, 2015

Related U.S. Application Data

(63) Continuation of application No. 12/888,304, filed on Sep. 22, 2010, now Pat. No. 9,090,397.

(60) Provisional application No. 61/244,835, filed on Sep. 22, 2009.

(51) Int. Cl.

| | |
|---|---|
| ***B65D 25/20*** | (2006.01) |
| ***A47G 19/22*** | (2006.01) |
| ***B65D 81/38*** | (2006.01) |
| *B65D 25/34* | (2006.01) |

(52) U.S. Cl.

CPC ..... *A47G 19/2205* (2013.01); *B65D 25/20* (2013.01); *B65D 81/3876* (2013.01)

(58) Field of Classification Search

CPC . B65D 25/20; B65D 81/3876; A47G 19/2205
USPC ..... 220/737, 738, 739, 23.91
See application file for complete search history.

(56) References Cited

U.S. PATENT DOCUMENTS 4,944,548 A 7/1990 Payne et al.
5,469,983 A * 11/1995 Yawata ..... B65D 25/2814 220/739
6,152,363 A * 11/2000 Rule, Jr. ..... B65D 81/3865 220/592.17
6,210,724 B1 * 4/2001 Clarke ..... B65D 77/225 426/106
6,718,733 B2 4/2004 Kilmartin
7,000,801 B2 2/2006 Rodriguez
7,264,134 B2 9/2007 Tulp
9,090,397 B2 7/2015 Colby
2002/0179617 A1 * 12/2002 Barthlow ..... B65D 5/747 220/714
2003/0111475 A1 6/2003 Cheng
2003/0116576 A1 6/2003 Lang-Boecker
2006/0086745 A1 * 4/2006 Morrison ..... A47G 23/0216 220/737
2007/0017924 A1 1/2007 Hundley
2007/0199947 A1 8/2007 Matlovich
2007/0215626 A1 9/2007 Wright et al.
2007/0257049 A1 11/2007 Tolan
2010/0025414 A1 2/2010 Mansour et al.

(Continued)

OTHER PUBLICATIONS

"Advisory Action", U.S. Appl. No. 12/888,304, dated Sep. 24, 2014, 3 pages.

(Continued)

*Primary Examiner* — J. Gregory Pickett
*Assistant Examiner* — Niki M Eloshway

(57) ABSTRACT

This document describes fixable cup sleeves. One of these cup sleeves is selectively fixable to a cup using a temperature-dependent adhesive that is effective to fix the cup sleeve to a disposable beverage cup when the cup is holding a warm or hot beverage. Another of these cups sleeves includes a fixing element capable of holding the cup sleeve in a closed position and fixing the cup sleeve to a disposable beverage cup when opened.

20 Claims, 2 Drawing Sheets

(56) References Cited

U.S. PATENT DOCUMENTS

| | | | | |
|---|---|---|---|---|
| 2010/0219195 | A1 | 9/2010 | Cook et al. | |
| 2011/0068114 | A1 | 3/2011 | Colby | |
| 2011/0101012 | A1 | 5/2011 | Tolley | |
| 2011/0139663 | A1* | 6/2011 | Cheema | B65D 75/18 206/494 |
| 2012/0325836 | A1* | 12/2012 | Nenniger | A47G 23/0216 220/720 |

OTHER PUBLICATIONS

"Final Office Action", U.S. Appl. No. 12/888,304, dated Jun. 9, 2014, 7 pages.
"Non-Final Office Action", U.S. Appl. No. 12/888,304, dated Sep. 27, 2013, 6 pages.
"Non-Final Office Action", U.S. Appl. No. 12/888,304, dated Nov. 20, 2014, 6 pages.
"Notice of Allowance", U.S. Appl. No. 12/888,304, dated Mar. 18, 2015, 4 pages.

* cited by examiner

CUP SLEEVE

RELATED APPLICATIONS

This application claims priority under 35 U.S.C. § 120 as a continuation of U.S. patent application Ser. No. 12/888,304, filed Sep. 22, 2010 and titled "Cup Sleeve", which claims priority to U.S. Provisional Patent Application No. 61/244,835, filed Sep. 22, 2009 and titled "Cup Sleeve," the entire disclosure of which are hereby incorporated by reference in its entirety.

BACKGROUND

Many disposable cups are used for holding hot beverages, such as coffee, tea, and hot chocolate. These cups often allow heat from the beverage to transfer to a person's hand through a holding surface of the cup. If the holding surface gets too hot, it can make holding the cup uncomfortable.

Often a cup sleeve is used to reduce the heat felt by a user by insulating the user from some of the heat on the holding surface of the cup. In some cases, however, a cup sleeve may be unstable on a cup. This may be annoying to a user because the cup sleeve may slip off of the cup. This instability also may cause a user to spill the beverage or upset the cup.

Adjustable cup sleeves may be especially prone to this problem. Many adjustable cup sleeves are capable of being placed around various differently sized disposable cups but to do so may fit imprecisely. This imprecise fit may make some adjustable cup sleeves even more prone to instability.

BRIEF DESCRIPTION OF THE DRAWINGS

The same numbers are used throughout the disclosure and figures to reference like components and features.

DETAILED DESCRIPTION

Overview

This document discloses fixable cup sleeves. One of these cup sleeves is fixable to a cup using a temperature-independent adhesive. Another of these cup sleeves is selectively fixable to a cup based on the temperature of a holding surface of the cup. Still another of these cups sleeves is capable of selectively adhering to a holding surface of a cup based on a surface characteristic of the holding surface. Still another of these cup sleeves is capable of being fixed to a cup by enabling a selective increase in friction between an interior surface of the cup sleeve and a holding surface of the cup. Fixable cup sleeves having hold-closed and/or open-exposed fixing elements are also described.

Fixable Cup Sleeves

Figure 1:
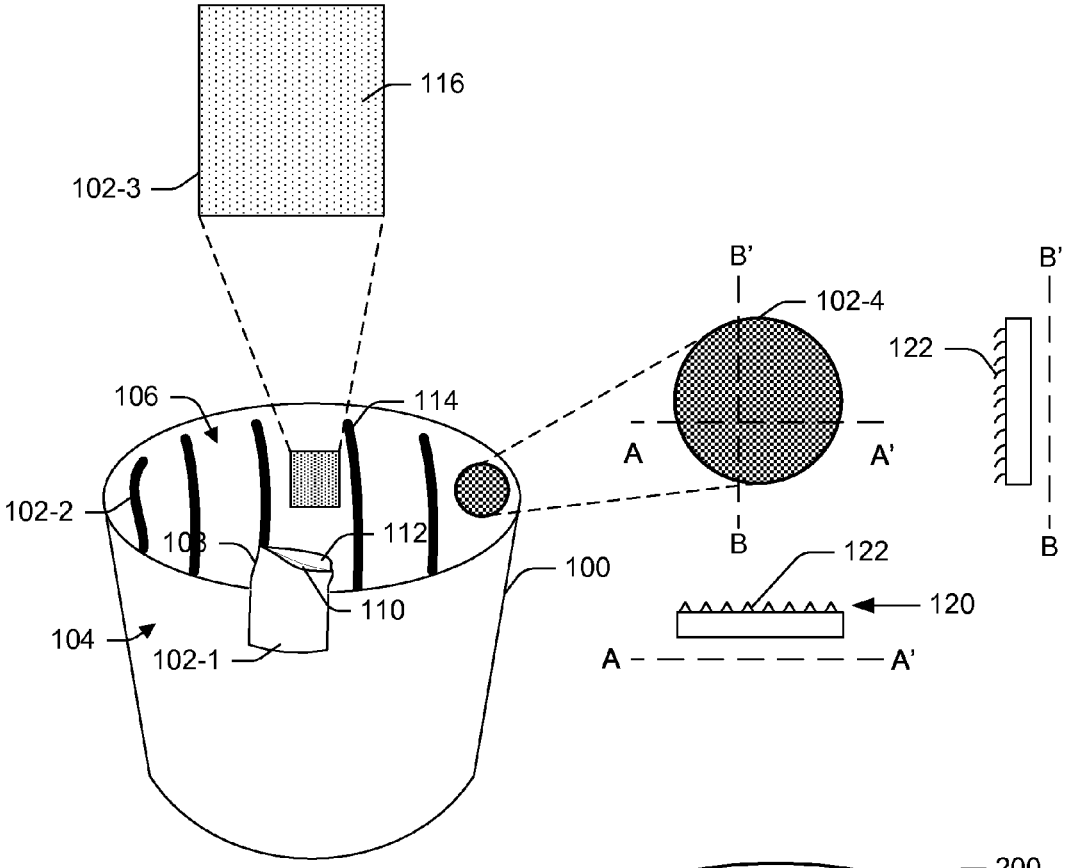
FIG. 1 illustrates an example cup sleeve having multiple fixing elements.

An example fixable cup sleeve 100 is illustrated in FIG. 1. This fixable cup sleeve 100 may include a disposable cup sleeve and one or more fixing elements 102-1 to 102-4 (referred to generally as 102). The disposable cup sleeve may include paper, plastic (e.g., polystyrene, polypropylene, and polyethylene terephthalate), and the like. The fixing element(s) include and adhesive element 102-1, a temperature-dependent adhesive 102-2, a selective surface adhesive 102-3, and/or a friction increaser 102-4, for example. Fixable cup sleeve 100 includes an exterior surface 104 and an interior surface 106. The exterior surface 104 is configured to be held by a human hand. The interior surface 106 is configured to surround at least a portion of a disposable beverage cup.

Adhesive Element

In some embodiments, fixable cup sleeve 100 includes a fixing element having an adhesive element. This adhesive element may be added to or formed on the exterior surface 104 of the sleeve or over part or substantially all of the interior surface 106 of the sleeve.

Figure 2:
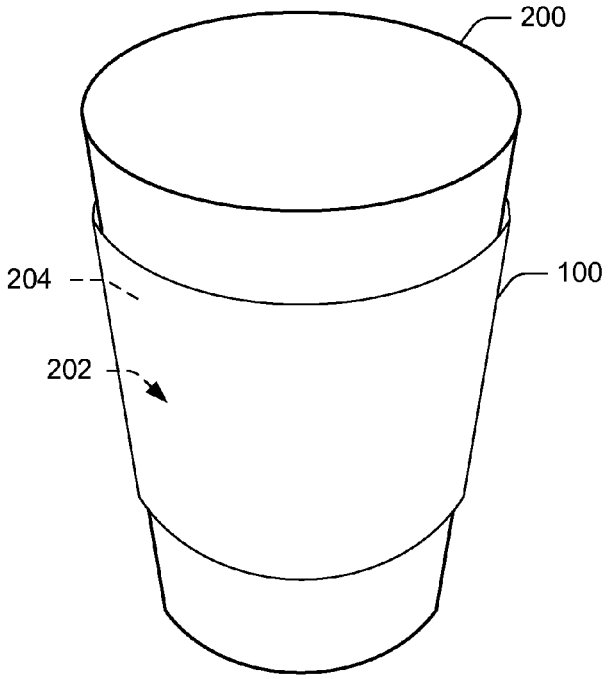
FIG. 2 illustrates the example cup sleeve of FIG. 1 fixed to an example disposable beverage cup.

In one of the illustrated embodiments shown in FIG. 1, adhesive element 102-1 is oriented on the exterior surface of the cup sleeve. Here the adhesive element includes a tab 108 having an adhesive 110 capable of fixing the fixable cup sleeve to a disposable beverage cup 200 shown in FIG. 2. The adhesive element may also include an adhesive selection element 112 to enable the adhesive element to selectively be fixed to the cup. The adhesive selection element shown in FIG. 1 may be pulled off to expose the adhesive 110, which may then be used to fix the fixable cup sleeve to the cup. Note that the adhesive element 102-1 may also be added to the interior surface of the cup sleeve, such as with a tab protruding from interior surface 106 of cup sleeve 100 as well as others manners described herein.

Temperature-Dependent Adhesive

In another embodiment, fixable cup sleeve 100 includes a fixing element having a temperature-dependent adhesive. This temperature-dependent adhesive may be formed over part or substantially all of interior surface 106 of the sleeve, for example. It may also be formed as part of adhesive 110 described above.

Referring again to FIG. 1, temperature-dependent adhesive 102-2 resides on the interior surface of fixable cup sleeve 100 and includes strips 114. In this illustrated embodiment, the temperature-dependent adhesive 102-2 includes an adhesive that is generally adhesive at temperatures about that of warm or hot beverages. The adhesive may, in some cases, also be generally non-adhesive at room temperature (about 55 to about 85° F.) to enable the sleeve to be stored without prematurely fixing to itself or another object.

This temperature-dependent adhesive 102-2 may also include, for example, an adhesive that is substantially non-adhesive at about 95° F. or below, but substantially adhesive at about 115° F. to about 180° F. (an example range of temperature of a holding surface of a paper disposable beverage cup holding a warm to hot beverage). This particular adhesive/non-adhesive range may be effective to permit the sleeve 100 to fix to the cup 200 if the cup contains a warm or hot beverage. A holding surface 202 of cup 200 may be, for instance, 130° F. very quickly after having a hot beverage, such as coffee at 160° F., poured into the cup. In this embodiment, when the holding surface 202 reaches about 115° F., the cup sleeve 100 fixes to the cup.

In another embodiment, this temperature-dependent adhesive 102-2 includes an adhesive that is slightly adhesive at room temperature and moderately or highly adhesive at about that of warm or hot beverages. In some cases, cup sleeves are stored in a flattened manner and stacked. Especially for cup sleeves stored in a flattened manner, it may be useful for the interior surface 106 to have an adhesive capable of holding the sleeve in a flattened shape until use. To do so, the adhesive may be applied on the interior surface 106 to adhere opposing halves of the interior surface 106 to each other. The adhesive is slightly adhesive at room temperatures to enable a user to open the flattened cup sleeve before using it without substantial difficulty or damage to the sleeve. Once placed over the cup 200 holding a hot beverage and having a temperature at its holding surface 202 well above room temperature (e.g., 115 or 130° F.), the adhesive of the temperature-dependent adhesive 102-2 fixes the sleeve 100 to the cup 200.

In still another embodiment, this temperature-dependent adhesive 102-2 includes multiple adhesives effective to be slightly adhesive at room temperature and more adhesive at about that of warm or hot beverages. In this embodiment, one adhesive can be slightly adhesive at room temperature and another highly adhesive at about that of warm or hot beverages.

In still another embodiment, this temperature-dependent adhesive 102-2 includes an adhesive such that once the sleeve 100 is fixed to the cup 200, the sleeve remains fixed to the cup even if the holding surface 202 of the cup cools to room temperature. This example adhesive can form a bond between the holding surface 202 and the interior surface 106 that, once it is made, is not particularly sensitive to temperature.

Selective-Surface Adhesive

In another embodiment, fixable cup sleeve 100 is capable of selectively adhering to a holding surface of a cup based in part on a surface characteristic of the holding surface. Here the fixable cup sleeve may be formed to include a fixing element having an adhesive capable of selectively adhering to certain surfaces. This selective-surface adhesive may be formed over part or substantially all of interior surface 106 of fixable cup sleeve 100, for example.

Referring again to FIG. 1, the selective-surface adhesive 102-3 resides on the interior surface of fixable cup sleeve 100. In this illustrated embodiment, the selective-surface adhesive 102-3 includes an adhesive that adheres to some surfaces and/or materials but not others. It may not, for instance, be adhesive to itself but be adhesive to holding surface 202 (covered by sleeve 100 in FIG. 2) of cup 200.

In one embodiment, the selective-surface adhesive is selectively adhesive to paper but not to itself. By so doing, it may be stored in a flattened form, for instance, without substantially adhering to itself. It may then, when needed, be placed over the cup 200, which here has a paper holding surface.

In another embodiment, the selective-surface adhesive is selectively adhesive to holding surface 202 based on a surface characteristic of the holding surface. This surface characteristic may include a complimentary selectively adhesive material 204 on, or making up, holding surface 202 to which the selective-surface adhesive 102-3 is selectively adherent.

This complimentary selectively adhesive material may not, in some cases, be adhesive to a person's hand, gloves, and the like. By so doing, the cup having this material on its holding surface may be used without the fixable cup sleeve. In one case, this complimentary selectively adhesive material includes a looped fabric-like material capable of adhering to a hooked material and vice versa (e.g., loop and pile). Also in this case, the selective-surface adhesive may include a hooked material capable of adhering to the pile material.

Friction Increaser

In another embodiment, fixable cup sleeve 100 may be formed to include a fixing element having a friction increaser capable of enabling the fixable cup sleeve to be fixed to a disposable beverage cup. This friction increaser may be formed over part or substantially all of interior surface 106 of fixable cup sleeve 100.

Referring again to FIG. 1, the friction increaser 102-4 is formed over the interior surface 106 of fixable cup sleeve 100. In this illustrated embodiment, the friction increaser 102-4 includes one or more materials having a high coefficient of friction with respect to a surface characteristic of holding surface 202 of cup 200, such as having a material over the holding surface including paper or an inexpensive plastic (e.g., polystyrene foam).

In one embodiment, the friction increaser includes a rough surface 116 that is hard enough to deform or otherwise alter the holding surface of the disposable cup. This rough surface may include a sandpaper-like surface (e.g., 80-grit sandpaper) capable of having a high coefficient of friction, thereby enabling a user to fix the fixable cup sleeve to the cup by pushing the fixable cup sleeve from the bottom of the cup until it fixes to the cup (assuming the cup is narrower at its bottom than it top). A user may also push the fixable cup sleeve up the cup and give it a turn, thereby potentially deforming or altering the holding surface, such as by scoring it horizontally. This horizontal scoring may provide vertical static friction to help prevent the fixable cup sleeve from slipping off of the cup.

In another embodiment, friction increaser 102-4 includes a variable-friction element 120. This variable-friction element 120 may include a material that has a lower friction when moving one direction than another. In this embodiment, variable-friction element 120 is effective to enable a user to push the fixable cup sleeve up the cup fairly easily. Once around the cup, variable-friction element 120 is more difficult to pull back down the cup than it was to push up it. This may enable fixable cup sleeve 100 to be fixed to cup 200 with minimal effort.

Note that the illustrated embodiment of variable-friction element 120 shows barbs 122 that, from one orientation will not engage the barbs (from A to A') but that from another orientation (from B to B') will engage the barbs. Thus, with this variable-friction element 120 a user may move the cup sleeve 100 up the cup 200 (from the bottom) easily but, once move up the cup 200, the variable-friction element 120 will make movement of the cup sleeve 100 difficult. This permits the cup sleeve 100 to be easily and securely fixed to the cup 200.

Hold-Closed Fixing Element

Figure 3:
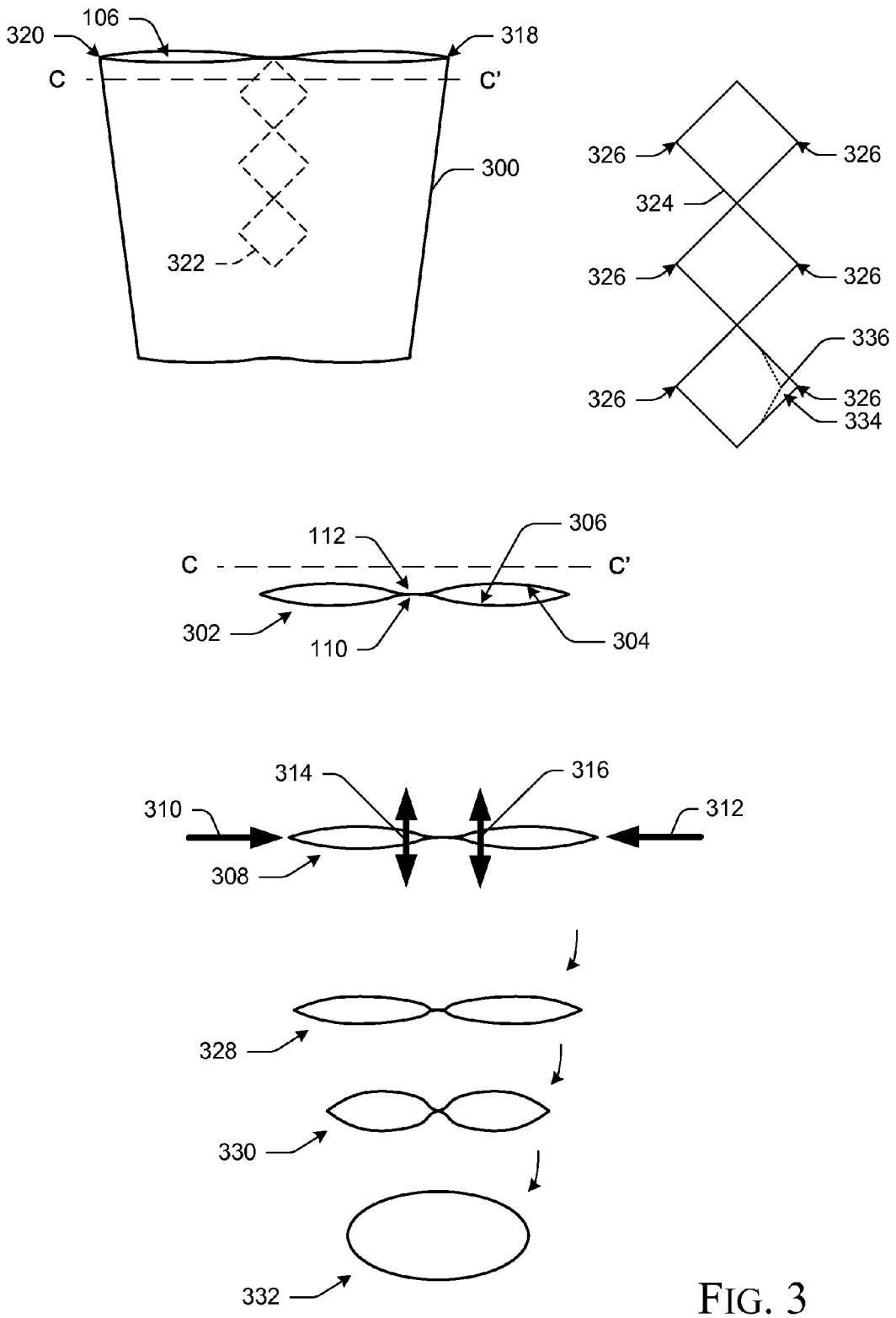
FIG. 3 illustrates the example cup sleeve of FIG. 1 with an example hold-closed fixing element and other aspects.

In another embodiment, fixable cup sleeve 100 may be formed to include a fixing element that holds fixable cup sleeve 100 closed (e.g., flattened, partially flattened, or concave). Consider a closed sleeve 300 (an example of fixable cup sleeve 100) shown in FIG. 3. Here closed sleeve 300 is partially flat to enable easy storage and/or selection by a user. In this embodiment one or more of fixing elements 102 holds fixable cup sleeve 100 closed until use.

Consider also a closed-sleeve view 302 along C to C' (representing a slice along C to C' and roughly a top-down view). Here adhesive selection element 112 is fixed to a first side 304 of interior surface 106, while adhesive 110 is fixed to a second side 306 of interior surface 106 (112 and 110 are similar to those shown in FIG. 1). On opening, adhesive selection element 112 may remain on first side 304 while adhesive 110 remains on second side 306. With adhesive selection element 112 removed from adhesive 110, adhesive 110 is now exposed and ready to fix cup sleeve 100 to holding surface 202 of disposable beverage cup 200 of FIG. 2. Note that both sides may also include adhesive selection element 112 and adhesive 110, thereby enabling cup sleeve 100 to be fixed to cup 200 at multiple points.

Open-Exposed Fixing Element

One or more of fixing elements 102 may be configured to enable exposure of an adhesive on opening fixable cup sleeve 100 from a closed position. Consider again closed sleeve 300 of FIG. 3. Here, as noted above, adhesive element 102-1 includes adhesive 110 and adhesive selection element 112, each of these disposed on opposing first and second sides 304 and 306 of interior surface 106. Adhesive selection element 112 is adhered to adhesive 110, but is of a material such that adhesive 110 and adhesive selection element 112 may be separated, often fairly easily. Furthermore, they may be separated without significantly damaging the ability of adhesive 110 to adhere to other surfaces, such as holding surface 202 (e.g., paper or plastic). Further still, adhesive element 102-1 can be configured to enable release of the hold keeping the sleeve closed by separation of adhesive selection element 112 from adhesive 110 based on a force pulling first and second sides 304 and 306 apart, either directly (e.g., pulling apart) or indirectly caused.

Consider a second closed-sleeve view similar to that of closed-sleeve view 302, here marked at 308 and excluding some markings for clarity. Here forces 310 and 312 are pushing at opposing ends, causing separation forces 314 and 316. These forces 310 and 312, such as from a user squeezing opposing ends 318 and 320 of closed sleeve 300 together, apply forces acting to separate adhesive selection element 112 from adhesive 110, which here also releases the hold to open the sleeve.

Furthermore, the fixing element holding closed sleeve 300 closed can be configured to concentrate these separation forces. Consider an example of adhesive element 102-1 of FIG. 1 shown in FIG. 3 at 322 (in dashed lines because hidden on interior surface 106 of closed sleeve 300 and also unhidden and enlarged to show detail at 324). The force-concentration adhesive element 322 and enlarged force-concentration adhesive element 324 include force-concentration structures, here illustrated by example only as structures 326. These have smaller sizes than those of a central section, here shown as pointed ends, three on each side, and are effective to concentrate separation forces 314 and 316 at a small portion of the adhesive selection element 112 and adhesive element 110 (e.g., at the pointed ends).

These structures permit the adhesive 110 and selective adhesive element 112 to begin to separate, thereby making opening the sleeve and exposing the adhesive relatively easy. The adhesive 110 can be exposed in a single action, here the squeezing of closed sleeve 300. This single action may also sufficiently open closed sleeve 300 to be ready for placement on disposable cup 200 of FIG. 2. This opening/releasing-of-the-hold is shown progressively (all from top-down views along C to C') at partially closed sleeve 328, partially opened sleeve 330, and open sleeve 332. At partially open sleeve 330, the adhesive is nearly, but not quite fully exposed. At open sleeve 332 the adhesive 110 is fully exposed. Note that other placements of fixing element 102 may be used that also permit forces 310 and 312 to create a separation force or forces on a fixing element, such as having fixing elements disposed toward one or more of ends 318 and 320 with an unclosed section in the middle. In such a case separation forces would also be caused by a user squeezing a closed sleeve, though oriented somewhat differently than the illustrated example.

Note that fixable cup sleeve 100 can be configured to have adhesives on both sides 304 and 306 of interior surface 106. In one case the top and bottom squares of enlarged force-concentration adhesive element 324 are switched with that of the middle square. Thus, when opened, the top and bottom have an adhesive on one of sides 304, 306 and the middle has an adhesive on the other of sides 304, 306. Other examples include smaller sections within other sections having reversed adhesive/non-adhesive sections (e.g., a square within a square).

Other example force concentrators are also contemplated, as are other ways in which to make opening the closed sleeve easy, such as an adhesive that is only slightly adhesive at some room temperature (e.g., 70° F.) but more adhesive at higher temperature, thereby making opening and exposing the adhesive to require little force. The structures, alternatively or in addition to adhesive characteristics, may vary to make opening and exposing the adhesive require little force. For example, structures having no adhesive can be used so that beginning the separation of selective adhesive element 112 from adhesive 110 takes almost no force, but because they are opening, the material of selective adhesive element 112 and adhesive 110 act to make separation take less force. Consider such a case at non-adhesive structure 334 shown as a portion of enlarged force-concentration adhesive element 324. Note that this structure 334 easily separates, as it has no adhesive, thereby causing separation force 316 (in this view going into and out of the page and not shown) to apply to point 336 aided by the stiffness (even if slight) of the material of elements 112 and 110.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

The invention claimed is:

1. A paper cup sleeve comprising:

a paper interior surface;

a first temperature-dependent adhesive on the paper interior surface, the first temperature-dependent adhesive being adhesive at or about 115° F. to 180° F. and capable of:

fixing the paper cup sleeve to a paper holding surface of a disposable beverage cup when the paper holding surface is at or about 115° F. to 180° F.; and after fixing to the paper holding surface of the disposable beverage cup, remaining fixed to the paper holding surface of the disposable beverage cup; and a second adhesive on the paper interior surface, the second adhesive different than the first temperature-dependent adhesive, the second adhesive being adhesive at or about 55° F. to 85° F. and configured to hold the paper cup sleeve closed.

2. The paper cup sleeve of claim 1, wherein the first temperature-dependent adhesive forms a bond between the paper holding surface of the disposable beverage cup and the interior surface of the cup sleeve when the paper holding surface of the disposable beverage cup is at or about 115° F. to 180° F.

3. The paper cup sleeve of claim 1, wherein the second adhesive is slightly adhesive at or about 55° F. to 85° F.

4. A cup sleeve comprising:

an interior surface;

an exterior surface; and two or more different materials in addition to one or more materials of which the interior or exterior surfaces is comprised, a first of the two or more different materials being adhesive at or about 55° F. to 85° F. and the second of the two or more different materials being a temperature-dependent adhesive, the exterior surface configured to be held by a human hand; and the interior surface having both the first and the second of the two or more different materials, the temperature-dependent adhesive of the second of the two or more different materials configured to fix the cup sleeve to a holding surface of a disposable beverage cup when the holding surface is at or about 115° F. to 180° F.

5. The cup sleeve of claim 4, wherein the temperature-dependent adhesive is non-adhesive at or about 55° F. to 85° F.

6. The cup sleeve of claim 4, wherein the temperature-dependent adhesive is configured to remain fixed to the holding surface of the disposable beverage cup when the holding surface of the disposable beverage cup cools to room temperature.

7. The cup sleeve of claim 4, wherein the adhesive of the first different material is slightly adhesive at or about 55° F. to 85° F.

8. The cup sleeve of claim 7, wherein the adhesive of the first different material is configured to hold the cup sleeve closed.

9. The cup sleeve of claim 8, wherein to hold the cup sleeve closed holds the cup sleeve flattened, partially flattened, or concave.

10. The cup sleeve of claim 8, wherein the first different material is configured to release the hold to open the cup sleeve responsive to a squeeze of opposing ends of the cup sleeve when the cup sleeve is closed.

11. The cup sleeve of claim 8, wherein the first or second different material is configured to concentrate separation forces caused by a squeeze of the opposing ends of the cup sleeve when the cup sleeve is closed.

12. The cup sleeve of claim 4, wherein the temperature-dependent adhesive is highly adhesive at or about 130° F. to 180° F.

13. The cup sleeve of claim 12, wherein the temperature-dependent adhesive forms a bond between the interior surface and the holding surface at or about 130° F. to 180° F.

14. The cup sleeve of claim 4, wherein the one or more materials of which the interior or exterior surfaces is comprised is paper.

15. A disposable cup sleeve comprising:

a sleeve including a first material, the sleeve having an interior surface; and a temperature-dependent adhesive on the interior surface, the temperature-dependent adhesive being adhesive at or about 115° F. to 180° F. and capable of:

fixing the disposable cup sleeve to a holding surface of a disposable beverage cup when the holding surface is at or about 115° F. to 180° F., the fixing of the disposable cup sleeve to the holding surface of the disposable beverage cup forming, through the temperature-dependent adhesive, a bond; and after fixing to the holding surface of the disposable beverage cup, remaining fixed to the holding surface of the disposable beverage cup, through the bond, when the holding surface of the disposable beverage cup cools to room temperature, the first material and the temperature-dependent adhesive being different materials.

16. The disposable cup sleeve of claim 15, wherein the first material includes paper.

17. The disposable cup sleeve of claim 16, wherein the holding surface includes paper and the temperature-dependent adhesive fixes the paper of the first material to the paper of the holding surface.

18. The disposable cup sleeve of claim 15, wherein the temperature-dependent adhesive is configured to hold the disposable cup sleeve closed.

19. The disposable cup sleeve of claim 18, wherein the temperature-dependent adhesive is configured to release the hold to open the disposable cup sleeve responsive to a squeeze of opposing ends of the disposable cup sleeve when the disposable cup sleeve is closed.

20. The disposable cup sleeve of claim 19, wherein the temperature-dependent adhesive is configured to concentrate separation forces caused by the squeeze of the opposing ends of the disposable cup sleeve when the cup sleeve is closed.

* * * * *